US008406268B2

(12) United States Patent
Carkin et al.

(10) Patent No.: US 8,406,268 B2
(45) Date of Patent: Mar. 26, 2013

(54) ELECTRODE HOLDER ASSEMBLY AND FURNACE COMPRISING SAME

(75) Inventors: Gerald E. Carkin, Tarentum, PA (US); Jarie-Erland Herstad, Nittedal (NO); Joseph Lepish, Lower Burrell, PA (US)

(73) Assignee: Alcoa Inc., Pittsburgh, PA (US)

( * ) Notice: Subject to any disclaimer, the term of this patent is extended or adjusted under 35 U.S.C. 154(b) by 0 days.

(21) Appl. No.: 13/259,049

(22) PCT Filed: Mar. 31, 2009

(86) PCT No.: PCT/US2009/038967

§ 371 (c)(1),
(2), (4) Date: Feb. 17, 2012

(87) PCT Pub. No.: WO2010/114525

PCT Pub. Date: Oct. 7, 2010

(65) Prior Publication Data

US 2012/0140788 A1 Jun. 7, 2012

(51) Int. Cl.
*H05B 7/10* (2006.01)
*H05B 7/11* (2006.01)

(52) U.S. Cl. ..... 373/100; 373/101; 373/94

(58) Field of Classification Search ..... 373/100, 373/101, 102, 69, 97, 94, 106, 89, 99, 104, 373/103

See application file for complete search history.

(56) References Cited

U.S. PATENT DOCUMENTS 2,778,865 A * 1/1957 Kongsgaarden ..... 373/100
2,845,468 A 7/1958 Haavik ..... 13/16
2,884,475 A * 4/1959 Foyn ..... 373/94
2,911,455 A 11/1959 Olsson et al. ..... 13/16
3,189,673 A 6/1965 Killin et al. ..... 13/14
3,898,364 A 8/1975 Hardin ..... 13/14
4,154,974 A 5/1979 Wynne ..... 13/16
4,646,317 A * 2/1987 Evensen ..... 373/101

OTHER PUBLICATIONS

International Search Report and Written Opinion, dated Dec. 4, 2009, from corresponding International Application No. PCT/US2009/038967.

* cited by examiner

*Primary Examiner* — Henry Yuen
*Assistant Examiner* — Hung D Nguyen
(74) *Attorney, Agent, or Firm* — Greenberg Traurig LLP

(57) ABSTRACT

In an embodiment, an electrode holder assembly (100) includes a current delivery base (105) having an interface (204) sufficiently designed to distribute an electrical current; a buss plate (200) sufficiently designed to provide the electrical current to the current delivery base (105); a shoe-ring assembly having: a plurality of electrical shoes (120), wherein the electrical current from the current delivery base (105) is distributed to the plurality of electrical shoes (120) for distribution to an electrode (400); a plurality of dual stroke cylinders (190); and a mounting ring (220); and a hydraulic assembly (300) including a grip ring (310) having an opening sufficiently designed to engage an outer surface of the electrode (400); a pressurizing cylinder (320) sufficiently designed to constrict and relax the grip ring (310); and at least one dual stroke cylinder (330) sufficiently designed to control horizontal movement of the grip ring (310) and the electrode (400).

20 Claims, 6 Drawing Sheets

ELECTRODE HOLDER ASSEMBLY AND FURNACE COMPRISING SAME

CROSS-REFERENCE TO RELATED APPLICATION

This patent application is a §371 national stage patent application based on International Patent Application No. PCT/US2009/038967, filed Mar. 31, 2009, entitled "ELECTRODE HOLDER ASSEMBLY AND FURNACE COMPRISING SAME", which is incorporated herein by reference in its entirety.

BACKGROUND

The conventional carbothermic Advanced Reactor Process is a multi-stage system in which a molten slag bath containing alumina and carbon is reacted to produce aluminum carbide in a low temperature stage. The resulting alumina-aluminum carbide slag then flows into a high temperature stage where the aluminum carbide is reacted with the alumina to produce aluminum metal. The aluminum is less dense than the slag and accumulates as a layer floating on the slag. The low temperature and high temperature stages are located in a common reaction vessel and are separated by an underflow partition wall. The high temperature stage has an outlet for continuously tapping molten aluminum. Additional carbon material is supplied to the high temperature stage to satisfy the reaction stoichiometry.

Energy required for the low temperature stage melting and pre-reduction is supplied by high intensity slag resistance heating using vertical carbonaceous electrodes submerged in the molten slag. Similarly, energy to the high temperature stage is high intensity slag resistance heating via a plurality of pairs of horizontally arranged electrodes through the sidewall of the reactor into the slag phase and below the metal phase.

SUMMARY

In an embodiment, a gripping, moving and electricity transfer electrode holder assembly capable of delivering electrical current at high densities is disclosed herein. According to an embodiment of the present invention, there is disclosed an electrode holder assembly that includes a current delivery base having an interface sufficiently designed to distribute an electrical current; a buss plate sufficiently designed to provide the electrical current to the current delivery base; a shoe-ring assembly comprising: a plurality of electrical shoes, each of the electrical shoes having a proximal end, a distal end, an outer surface and an inner surface, wherein the electrical current from the interface of the current delivery base is distributed to the plurality of electrical shoes, and wherein the electrical current from the plurality of electrical shoes is distributed to the electrode; a plurality of dual stroke cylinders equal in number to the plurality of electrical shoes, wherein each of the dual stroke cylinders is engaged to and spaced apart from the proximal end of each of the electrical shoes, wherein each of the dual stroke cylinders individually controls each of the electrical shoes, wherein each of the dual stroke cylinders is sufficiently designed to apply pressure to each of the electrical shoes to contact the electrode, and wherein each of the dual stroke cylinders is sufficiently designed to pull back on each of the electrical shoes to allow slipping of the electrode; and a mounting ring having a plurality of openings equal in number to the plurality of dual stroke cylinders, wherein the plurality of dual stroke cylinders extend through the plurality of openings; and a hydraulic assembly comprising: a grip ring having a central opening sufficiently designed to engage an outer surface of the electrode, wherein the grip ring includes components moveable relative to one another; a pressurizing cylinder sufficiently designed to constrict and relax the grip ring, wherein the pressurizing cylinder engages the components of the grip ring; and at least one dual stroke cylinder sufficiently designed to control horizontal movement of the grip ring and the electrode.

According to an embodiment of the present invention, there is disclosed a furnace that includes a shell including a plurality of sidewalls and a lower bowl; a roof; an electrical system; and a holder assembly for an electrode horizontally interrupting at least two of the sidewalls, the holder assembly comprising: a current delivery base sufficiently designed to distribute an electrical current; a buss plate sufficiently designed to provide the electrical current to the current delivery base, the electrical current supplied by the electrical system; a shoe-ring assembly comprising: a plurality of electrical shoes, each of the electrical shoes having a proximal end, a distal end, an outer surface and an inner surface, wherein the electrical current from the current delivery base is distributed to the plurality of electrical shoes, wherein the electrical current from the plurality of electrical shoes is distributed to the electrode; a plurality of dual stroke cylinders equal in number to the plurality of electrical shoes, wherein each of the dual stroke cylinders is engaged to and spaced apart from the proximal end of each of the electrical shoes, wherein each of the dual stroke cylinders individually controls each of the electrical shoes, wherein each of the dual stroke cylinders is sufficiently designed to apply pressure to each of the electrical shoes to contact the electrode, and wherein each of the dual stroke cylinders is sufficiently designed to pull back on each of the electrical shoes to allow slipping of the electrode; and a mounting ring having a plurality of openings equal in number to the plurality of dual stroke cylinders, wherein the plurality of dual stroke cylinders extend through the plurality of openings; and a hydraulic assembly comprising: a grip ring having a central opening sufficiently designed to engage an outer surface of the electrode, wherein the grip ring includes components moveable relative to one another; a pressurizing cylinder sufficiently designed to constrict and relax the grip ring, wherein the pressurizing cylinder engages the components of the grip ring; and at least one dual stroke cylinder sufficiently designed to control horizontal movement of the grip ring and the electrode.

BRIEF DESCRIPTION OF THE DRAWINGS

The present invention will be further explained with reference to the attached drawings, wherein like structures are referred to by like numerals throughout the several views. The drawings shown are not necessarily to scale, with emphasis instead generally being placed upon illustrating the principles of the present invention.

FIG. 5A is a top plan view of a single electrical shoe engaged to and spaced apart from a single dual stroke cylinder via a pin. FIG. 5B is a cross-sectional view taken along line B-B of FIG. 5A. FIG. 5C is a close-up view of region C of FIG. 5 B showing the engagement of the pin to the single electrical shoe.

While the above-identified drawings set forth presently disclosed embodiments, other embodiments are also contemplated, as noted in the discussion. This disclosure presents illustrative embodiments by way of representation and not limitation. Numerous other modifications and embodiments can be devised by those skilled in the art which fall within the scope and spirit of the principles of the present invention.

DETAILED DESCRIPTION

Figure 1:
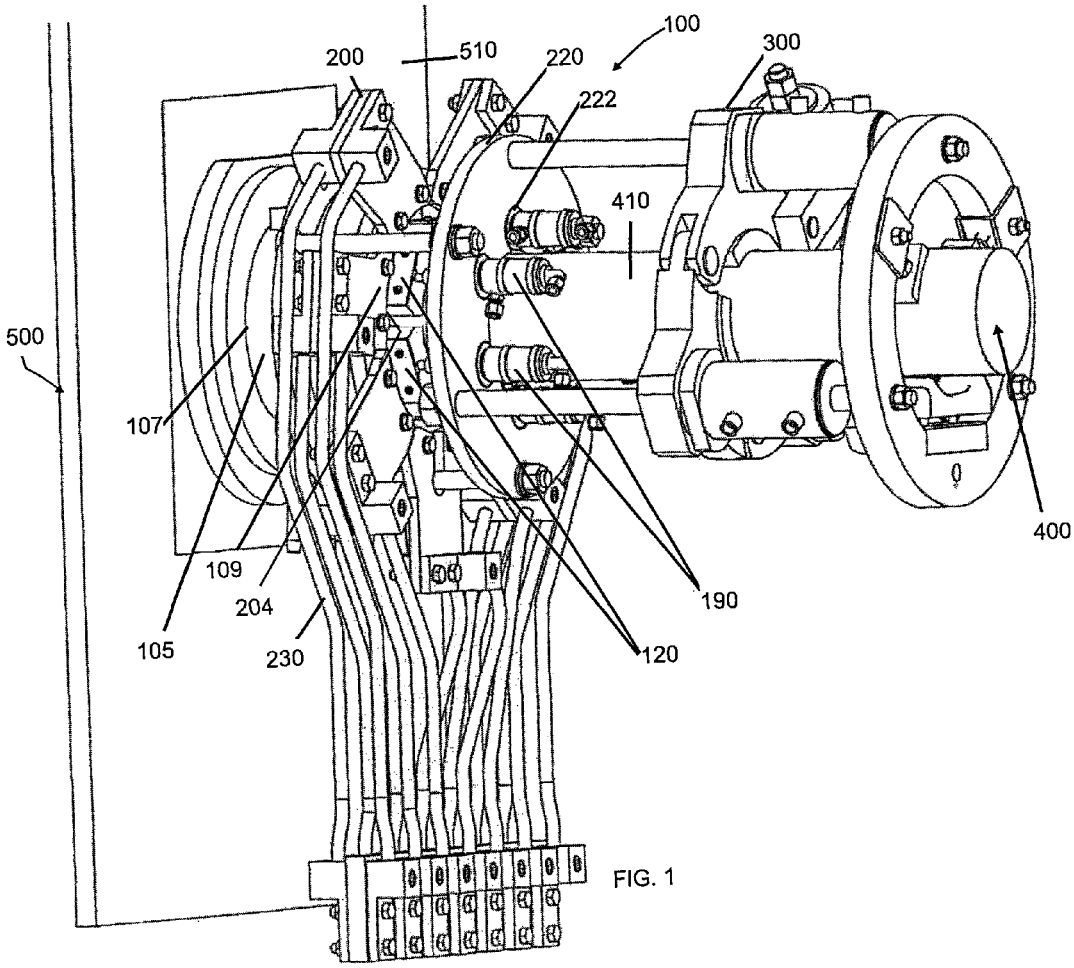
FIG. 1 shows an isometric view of an embodiment of an electrode holder assembly of the present disclosure positioned horizontally and engaging with a sidewall of a furnace.
Figure 2:
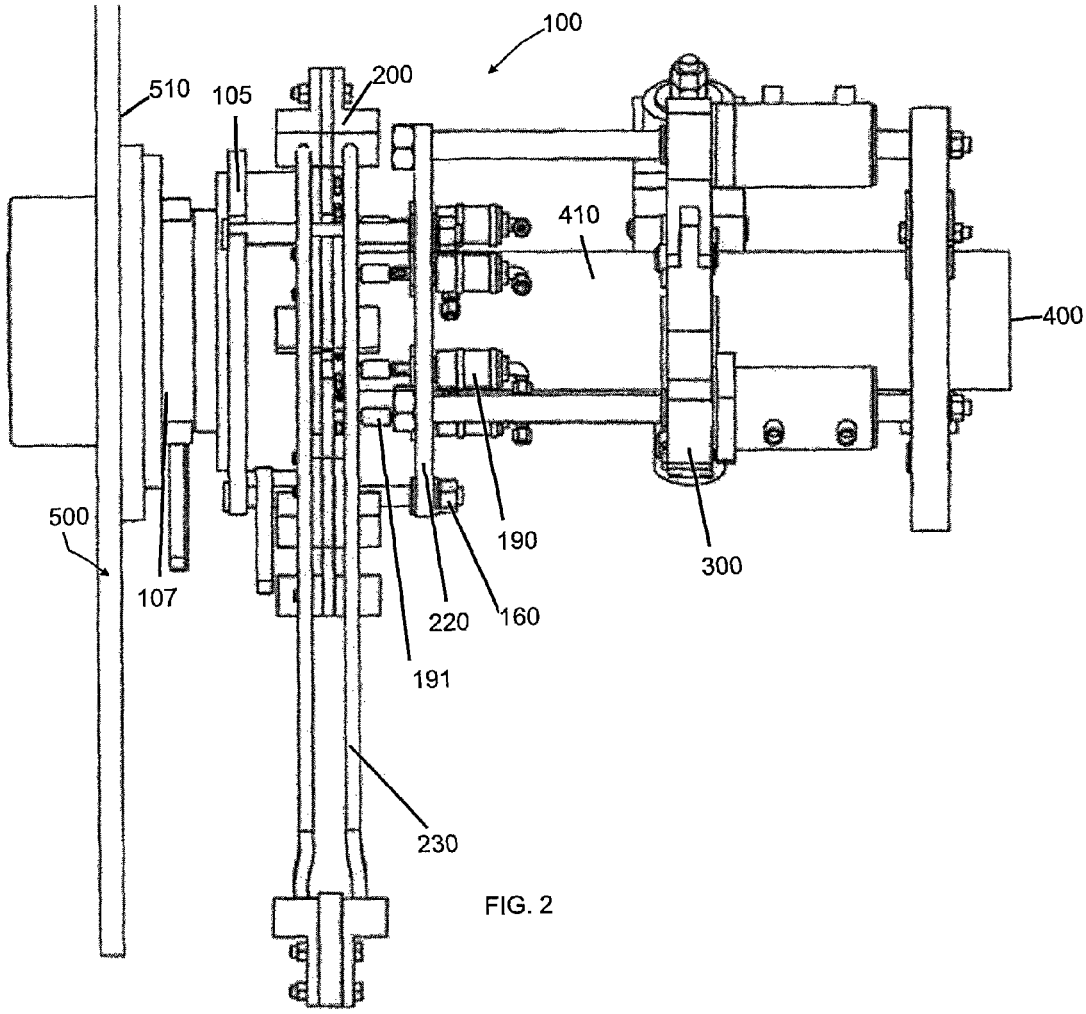
FIG. 2 shows a side view of the electrode holder assembly of FIG. 1.
Figure 3:
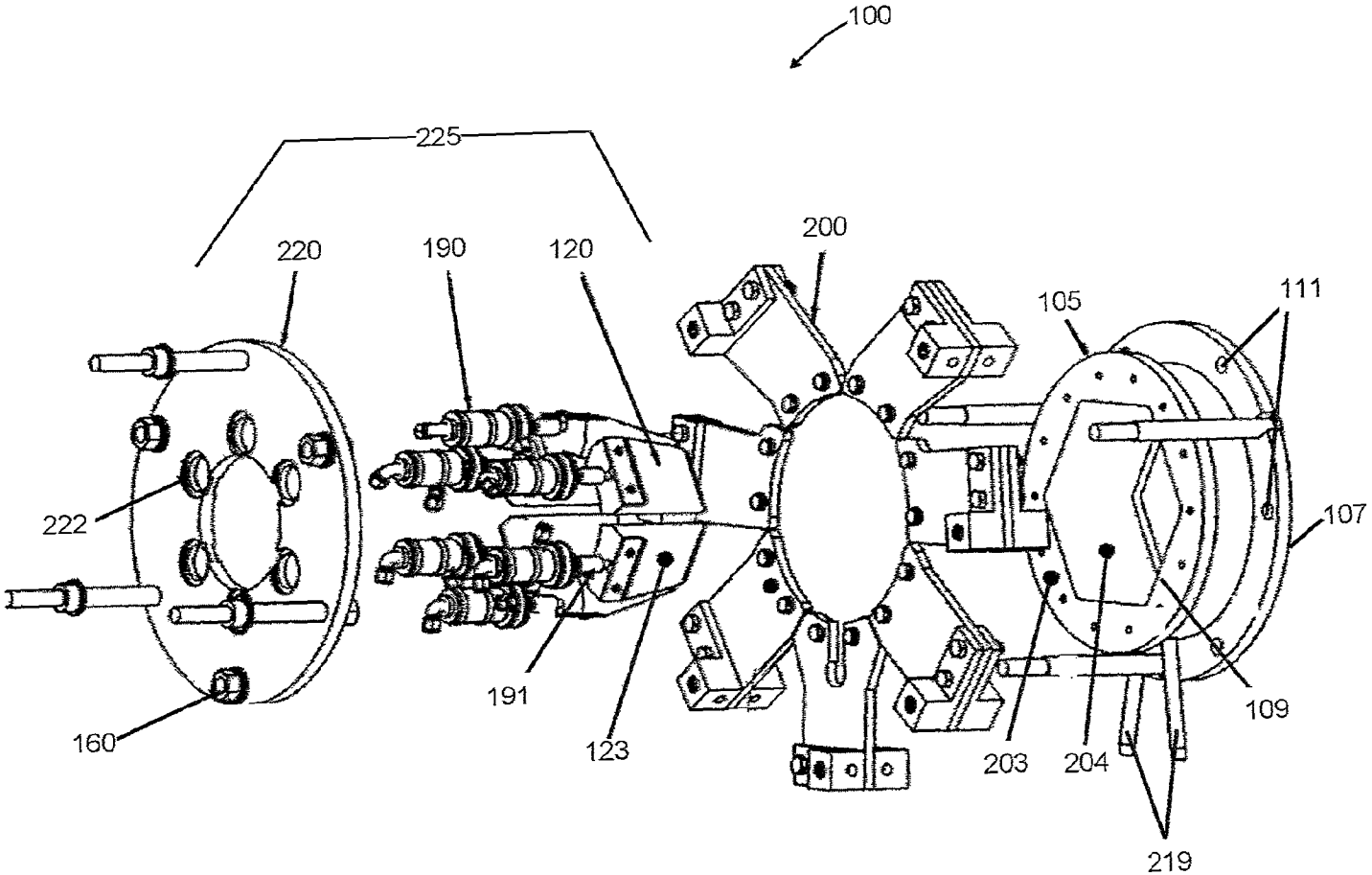
FIG. 3 shows an isometric exploded view of some of the components of the electrode holder assembly of FIG. 1.

FIGS. 1 and 2 in conjunction with FIG. 3, show an embodiment of an electrode holder assembly 100 of the present invention. The assembly 100 includes a circumferential hollowed-out current delivery base 105 having a proximal end 107, a distal end 109, and an interface 204 therebetween. The proximal end 107 of the current delivery base 105 is positioned horizontally to extend through a sidewall 510 of a furnace 500, as illustrated in FIGS. 1 and 2. The assembly 100 also includes a buss plate 200 that is connected with cables 230 leading from a transformer located adjacent to the furnace (not shown). the cables 230 can be cooled either water or a cooling media. A shoe-ring assembly 225 includes a plurality of electrical shoes 120, a corresponding plurality of dual stroke (hydraulic) cylinders 190, equal in number to the plurality of electrical shoes 120, and a mounting ring 220 having a plurality of openings 222 equal in number to the plurality of dual stroke cylinders 190. The openings 222 of the mounting ring 220 are spaced at an approximate equal distance apart from one another. In an embodiment, the electrical shoes 120 are positioned about the perimeter of the mounting ring 220 through the openings 222, such as equally/uniformly spaced about the perimeter of the mounting ring 220 (e.g., at positions corresponding with 1 o'clock, 2 o'clock, 3 o'clock, etc., relative to a traditional wall clock). The plurality of electrical shoes 120 may be positioned in such a manner via the plurality of connecting pins 191. The plurality of dual stroke cylinders 190 extend through the plurality of openings 222. The mounting ring 220 can be attached to the current delivery base 105 by a set of isolated bolts 160. Each of the dual stroke cylinders 190 individually controls each of the corresponding electrical shoes 120, as will be described in detail below, Each of the dual stroke cylinders 190 is sufficiently designed to apply pressure to each of the electrical shoes 120 to contact the electrode 400. Each of the dual stroke cylinders 190 is sufficiently designed to pull back on each of the electrical shoes 120 to allow slipping of the electrode 400.

The buss plate 200 is sufficiently designed to provide electrical current to the interface 204 of the current delivery base 105, and the interface 204 of the current delivery base 105 is sufficiently designed to distribute the electrical current to the electrical shoes 120. The electrical current from the plurality of electrical shoes 120 is distributed to an electrode 400. The electrode 400 typically consists of any current carrying material. For example, the electrode 400 can be made from graphite, copper, a self-baking carbon-containing electrodermass, or a combination thereof. A hollow interior of the mounting ring 220, the buss plate 200 and the current delivery base 105 are sized to allow the electrode 400 to be pushed therethrough without those inner surfaces contacting an outer surface 410 of the electrode 400. A hydraulic assembly 300 allows for the electrode 400 to be inserted into the furnace 500 based on a set of predetermined parameters.

Figure 4:
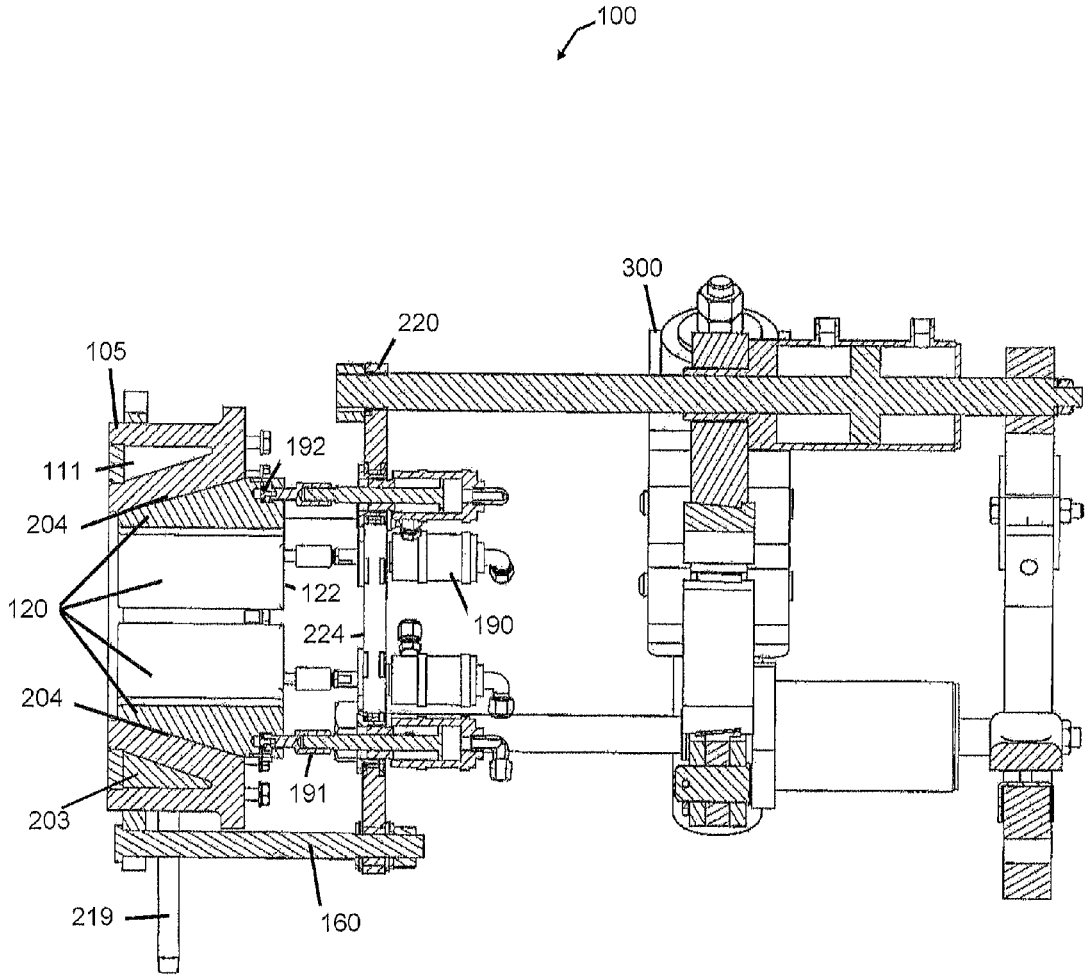
FIG. 4 shows a side cross-sectional view of the electrode holder assembly of FIG. 1.

FIG. 4 shows a side cross-sectional view of the electrode holder assembly 100 of FIG. 1 (the furnace and the buss plate are not illustrated). The current delivery base 105 includes a hollow chamber 111 running concentrically to the circumference through which cooling media 203 is pumped through, thus providing a means of controlling the temperature of the interface 204. A baffle plate divides the hollow chamber 111. On one side of the baffle plate is an inlet for the cooling media. Cooling media 203 flows around the hollow chamber 111 and exits out the other side of the baffle plate. The cooling media 203 enters and exits through pipes 219 that may be part of an integral cooling system or may be a separate water system. In an embodiment, the cooling media 203 is selected from one of air, water, oil (e.g., PerFluoroPolyEther oil or HydroFluoroPolyEther oil), glycol, or combinations thereof. Controlling the temperature of the interface 204 results in an electrode holder assembly 100 capable of withstanding a large amp load without burning up the electrode 400 external to the furnace 500. This leads to the stabilization of the consumption of the electrode 400, as well as the stability of the current delivered to the process (which is a result of uniformly distributed electrical energy around the circumference of the electrode 400 at the contact points. This eliminates power spikes on any one part of the electrode 400 and power losses due to poor contact in others). Greater stability of process power should also allow for greater stability of the process itself. As illustrated in FIG. 4, the electrical shoes 120 are generally electrically isolated from the mounting ring 220 due to the spacing between a distal end 122 of the electrical shoes 120 and a proximal side 224 of the mounting ring 220, as well as due to the use of insulation washers 192 at the connecting pins 191. Furthermore, insulation sleeves substantially electrically isolate the bolts 160 from the remainder of the shoe-ring assembly 225. In this regard, the insulation sleeves generally substantially circumscribe at least a portion of the outer surface of the bolts 160.

Figures 5A, 5B, 5C:
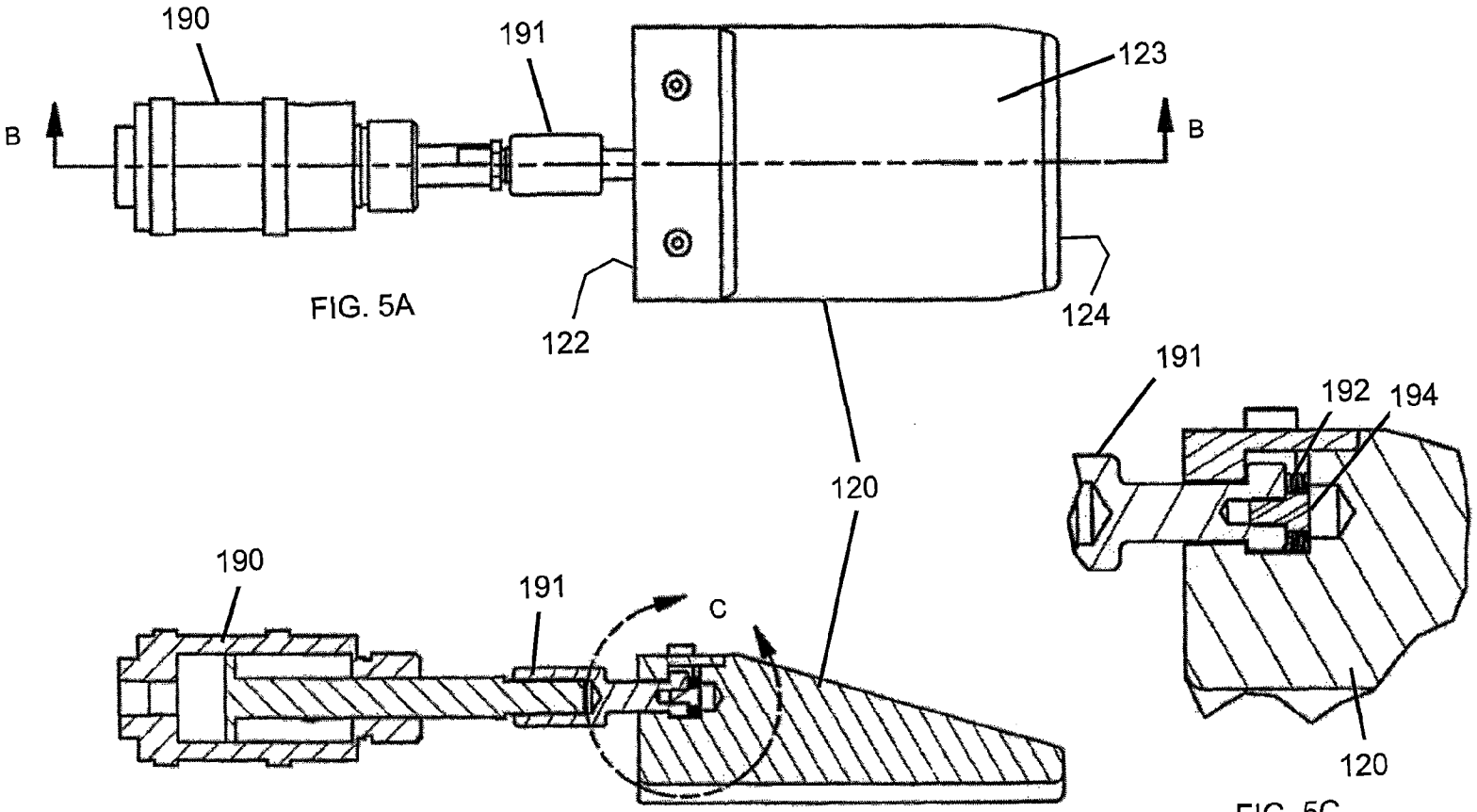
FIGS. 5A-5C show some of the component features of the electrode holder assembly of FIG. 1.

FIGS. 5A-5C show how the electrical shoes 120 are mechanically interconnected to the dual stroke cylinders 190 via mounting slots/caps 194 and pins 191 Each electrical shoe 120 generally comprises a distal end 122 and a proximal end 124. Each electrical shoe 120 is generally positioned such that an outer surface 123 of the electrical shoe 120 is capable of engaging the interface 204 of the current delivery base 105. Each electrical shoe 120 is wedged hydraulically between the interface 204 of the current base 105 and the electrode 400. Each of the dual stroke cylinders 190 is capable of applying pressure to: wedge a corresponding electrical shoe 120 to make electrical contact with the electrode 400, or pull back on the corresponding electrical shoe 120 to allow slipping of the electrode 400. The electrode holder assembly 100 of the present invention divides the current delivery into multiple contacts, allowing for better control of the contact area between each of the electrical shoes 120 and the electrode 400. Having each electrical shoe 120 hydraulically controlled removes the problems associated with expansion, contraction and point loading typically found in electrode clamping devices. By having multiple contact points and a constant pressure on each electrical shoe 120, the current can be distributed evenly around the electrode 400 evening out the temperature generated by the energy being delivered through the electrode 400.

Figure 6:
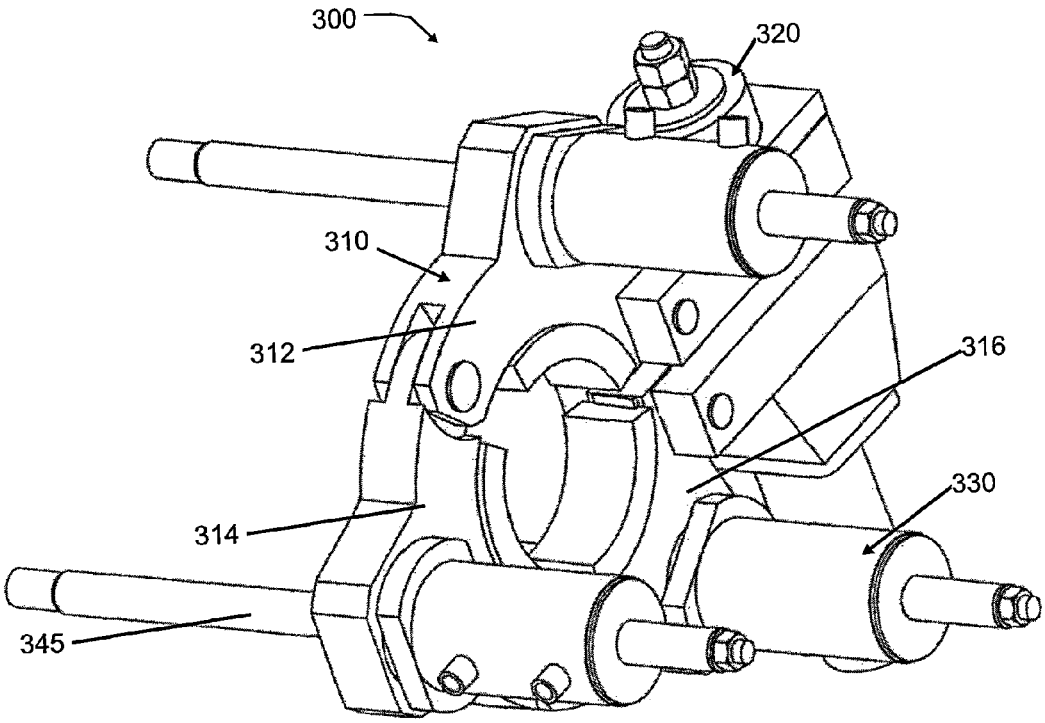
FIG. 6 shows an isometric view of a hydraulic assembly component of the electrode holder assembly of FIG. 1.

FIG. 6 shows an isometric view of the hydraulic assembly 300. The hydraulic assembly 300 includes a grip ring 310 having a central opening sufficiently designed to engage the outer surface 410 of the electrode 400, a pressurizing cylinder 320 sufficiently designed to constrict and relax the grip ring 310, and at least one dual stroke cylinder 330 sufficiently designed to control horizontal movement of the grip ring 310 and the electrode 400. A series of bolts 345 spanning a thickness of the grip ring 310 attaches the hydraulic assembly 300 with the mounting ring 220. The grip ring 310 includes components 312, 314, and 316, moveable relative to one another. The grip ring 310 is a hydraulically controlled ring that constricts around the circumference of the electrode 400 to move the electrode 400 into the furnace 500 and then relaxed to move back to a home position. The pressurizing cylinder 320 engages components 312 and 316 of the grip ring 310. In an embodiment, the hydraulic assembly 300 includes three dual stroke cylinders 330, although the present disclosure is not intended to be limited by the number of dual stroke cylinders 300 featured as part of the hydraulic assembly 300. The dual stroke cylinders 330 are integrated to perform synchronously with the dual stroke (hydraulic) cylinders 190 and are controlled by the same control system.

In initial assembly, the electrode 400 is pushed down the center of the hydraulic assembly 300. During this time, the proximal ends 124 of the electrical shoes 120 generally do not physically interact with the distal end 109 of the current delivery base 105. However, the proximal ends 124 of the electrical shoes 120 will physically engage the outer surface 410 of the electrode 400, while the distal ends 122 of the electrical shoes 120 do not physically engage the outer surface 410 of the electrode 400 due to the wedge shape of the electrical shoes 120. After the electrode 400 has been moved into a suitable position, the dual stroke cylinders 190 are pressurized. The proximal ends 124 of the electrical shoes 120 are pushed against the distal end 109 of the current delivery base 105 via the dual stroke cylinders 190, thereby achieving mechanical pressure between the electrical shoes 120 and the interface 204 of the current delivery base 105. In an embodiment, spring washers 192 may be utilized in conjunction with the connecting pins 191 to facilitate uniform pressure distribution between each of the electrical shoes 120, the interface 204 and the surface of the electrode 400 (as clearly illustrated in the embodiment depicted in FIG. 5C). In an embodiment, each electrical shoe 120 is held in compression by the spring washers 192 allowing for thermal expansion and contraction of the assembly 100.

An electrical load is provided to the interface 204 via the buss plate 200. This current flows through the electrical shoes 120 and into the electrode 400 via the wedge-shaped proximal ends 124 of the electrical shoes 120. Due to the uniform spacing of the electrical shoes 120, a fairly uniform electrical load may be provided to the electrode 400, and hence, from the electrode 400 to the furnace 500. Over time, the electrode 400 may experience wear from use in the furnace 500. The assembly 100 may be utilized to insert an additional portion of the electrode 400 into the furnace 500. To do so, flow of electrical current to the interface 204 may be stopped. Next, the dual stroke cylinders 190 may retract the electrical shoes 120 relative to the interface 204 and the electrode 400, thereby positioning electrical shoes 120 towards a more distal portion of the electrode 400 and removing physical contact between the electrical shoes 120 and the interface 204. The hydraulic assembly 300 may cause the grip ring 310 to physically engage the outer surface 410 of the electrode 400 by constricting the circumference pressurizing cylinder 320 after which the hydraulic assembly 300 may force the electrode 400 interconnected therewith via the grip ring 310 toward the interface 400, thereby pushing an additional amount of the electrode 400 into the furnace 500. The dual stroke cylinders 190 may subsequently be pressurized. This process may be repeated as necessary to provide additional electrode 400 to the interior of the furnace 500, after which the electrical shoes 120 may be reengaged with the interface 204 and electrical current provided to the electrode 400, via the electrical shoes 120, as described above.

In an embodiment, the electrical shoes 120 are uniformly spaced about the mounting ring 220, and provide a uniform current distribution to the electrode 400 eliminating "spot" currents that can cause excessive heat build up. Furthermore, the pressure on each electrical shoe 120 may be individually tailored by adjusting nuts and or spring washers, thus facilitating an equal pressure distribution among the electrical shoes 120, the interface 204 and the electrode 400. Such substantially equal pressurization of the electrical shoes 120 may facilitate equal voltage drops around the electrode 400, which may further facilitate equal current transfer. Moreover, imperfections in the outer surface 410 of the electrode 400 may not affect performance of the electrode 400 since the individual electrical shoes 120 may be adjusted to match the outer surface 410 of the electrode 400, thereby allowing for the use of electrodes "as received", and hence reducing the concern associated with, and possible associated costs and time considerations, of using imperfect/irregular electrodes. There is no need for perfect electrodes as the electrical shoes 120 can adjust for changing diameters, out of round and irregular surfaces.

The electrode holder assembly 100 of the present invention finds use with various industrial furnace types, including, but not limited to, heating-, melting-, reduction-, smelting-, arc-, reactive- and reaction-type furnaces, and can be designed for any size electrode. In an embodiment, the electrode holder assembly 100 is installed on a submerged-type furnace.

What is claimed is:

1. An electrode holder assembly comprising:

a current delivery base having an interface designed to distribute an electrical current;

a buss plate designed to provide the electrical current to the current delivery base;

a shoe-ring assembly comprising:

a plurality of electrical shoes, each of the electrical shoes having a proximal end, a distal end, an outer surface and an inner surface, wherein the electrical current from the interface of the current delivery base is distributed to the plurality of electrical shoes, and wherein the electrical current from the plurality of electrical shoes is distributed to an electrode;

a plurality of dual stroke cylinders equal in number to the plurality of electrical shoes, wherein each of the dual stroke cylinders is engaged to and spaced apart from the proximal end of each of the electrical shoes, wherein each of the dual stroke cylinders individually controls each of the electrical shoes, wherein each of the dual stroke cylinders designed to apply pressure to each of the electrical shoes to contact the electrode, and wherein each of the dual stroke cylinders designed to pull back on each of the electrical shoes to allow slipping of the electrode; and a mounting ring having a plurality of openings equal in number to the plurality of dual stroke cylinders, wherein the plurality of dual stroke cylinders extend through the plurality of openings; and a hydraulic assembly comprising:

a grip ring having a central opening designed to engage an outer surface of the electrode, wherein the grip ring includes components moveable relative to one another;

a pressurizing cylinder designed to constrict and relax the grip ring, wherein the pressurizing cylinder engages the components of the grip ring; and at least one dual stroke cylinder designed to control horizontal movement of the grip ring and the electrode.

2. The electrode holder assembly of claim 1 wherein an electrical system delivers the electrical current to the buss plate.

3. The electrode holder assembly of claim 1 wherein the holder assembly is interconnected horizontally with a furnace.

4. The electrode holder assembly of claim 3 wherein when the grip ring is constricted the at least one dual stroke cylinder is capable of moving the grip ring and the electrode toward the furnace a pre-determined distance.

5. The electrode holder assembly of claim 3 wherein when the grip ring is relaxed the at least one dual stroke cylinder is capable of moving the grip ring and the electrode away from the furnace a pre-determined distance.

6. The electrode holder assembly of claim 1 wherein the electrical current from the plurality of electrical shoes is distributed evenly around the electrode.

7. The electrode holder assembly of claim 1 wherein a temperature generated by energy delivered through the electrode is about uniform at any given time.

8. The electrode holder assembly of claim 1 wherein the current delivery base is cooled with a cooling media.

9. The electrode holder assembly of claim 8 wherein the cooling media is selected from one of air, water, oil, glycol, gladden or combinations thereof.

10. The electrode holder assembly of claim 1 wherein the plurality of electrical shoes are electrically isolated from the mounting ring.

11. The electrode holder assembly of claim 1 wherein the hydraulic assembly comprises three dual stroke cylinders.

12. A furnace comprising:

a shell including a plurality of sidewalls and a lower bowl;

a roof;

an electrical system; and a holder assembly for an electrode horizontally interrupting at least two of the sidewalls, the holder assembly comprising:

a current delivery base designed to distribute an electrical current;

a buss plate designed to provide the electrical current to the current delivery base, the electrical current supplied by the electrical system;

a shoe-ring assembly comprising:

a plurality of electrical shoes, each of the electrical shoes having a proximal end, a distal end, an outer surface and an inner surface, wherein the electrical current from the current delivery base is distributed to the plurality of electrical shoes, and wherein the electrical current from the plurality of electrical shoes is distributed to the electrode;

a plurality of dual stroke cylinders equal in number to the plurality of electrical shoes, wherein each of the dual stroke cylinders is engaged to and spaced apart from the proximal end of each of the electrical shoes, wherein each of the dual stroke cylinders individually controls each of the electrical shoes, wherein each of the dual stroke cylinders is designed to apply pressure to each of the electrical shoes to contact the electrode, and wherein each of the dual stroke cylinders is designed to pull back on each of the electrical shoes to allow slipping of the electrode; and a mounting ring having a plurality of openings equal in number to the plurality of dual stroke cylinders, wherein the plurality of dual stroke cylinders extend through the plurality of openings; and a hydraulic assembly comprising:

a grip ring having a central opening designed to engage an outer surface of the electrode, wherein the grip ring includes components moveable relative to one another;

a pressurizing cylinder designed to constrict and relax the grip ring, wherein the pressurizing cylinder engages the components of the grip ring; and at least one dual stroke cylinder designed to control horizontal movement of the grip ring and the electrode.

13. The furnace of claim 12 wherein the plurality of electrical shoes are wedged hydraulically between the current delivery base and the interface delivering current to the electrode.

14. The furnace of claim 12 wherein when the grip ring is constricted the at least one dual stroke cylinder is capable of moving the grip ring and the electrode toward the furnace a pre-determined distance.

15. The furnace of claim 12 wherein when the grip ring is relaxed the at least one dual stroke cylinder is capable of moving the grip ring and the electrode away from the furnace a pre-determined distance.

16. The furnace of claim 12 wherein the electrical current from the plurality of electrical shoes is distributed evenly around the electrode.

17. The furnace of claim 12 wherein a temperature generated by energy delivered through the electrode is about uniform at any given time.

18. The furnace of claim 12 wherein the current delivery base is cooled.

19. The furnace of claim 12 wherein the plurality of electrical shoes are electrically isolated from the mounting ring.

20. The furnace of claim 12 wherein the hydraulic assembly comprises three dual stroke cylinders.

* * * * *